US008812313B2

(12) United States Patent
Arakawa et al.

(10) Patent No.: US 8,812,313 B2
(45) Date of Patent: Aug. 19, 2014

(54) VOICE ACTIVITY DETECTOR, VOICE ACTIVITY DETECTION PROGRAM, AND PARAMETER ADJUSTING METHOD

(75) Inventors: Takayuki Arakawa, Minato-ku (JP); Masanori Tsujikawa, Minato-ku (JP)

(73) Assignee: NEC Corporation, Tokyo (JP)

( * ) Notice: Subject to any disclaimer, the term of this patent is extended or adjusted under 35 U.S.C. 154(b) by 530 days.

(21) Appl. No.: 13/140,364

(22) PCT Filed: Dec. 7, 2009

(86) PCT No.: PCT/JP2009/006666

§ 371 (c)(1),
(2), (4) Date: Jun. 16, 2011

(87) PCT Pub. No.: WO2010/070840

PCT Pub. Date: Jun. 24, 2010

(65) Prior Publication Data

US 2011/0251845 A1 Oct. 13, 2011

(30) Foreign Application Priority Data

Dec. 17, 2008 (JP) ..... 2008-321551

(51) Int. Cl.
*G10L 21/00* (2013.01)

(52) U.S. Cl.
USPC ..... 704/233; 704/246; 379/390.03

(58) Field of Classification Search
USPC ..... 704/233, 246; 379/390.03
See application file for complete search history.

(56) References Cited

U.S. PATENT DOCUMENTS

| | | | | |
|---|---|---|---|---|
| 7,454,010 | B1 * | 11/2008 | Ebenezer | 379/392.01 |
| 2002/0120440 | A1 * | 8/2002 | Zhang | 704/215 |
| 2011/0066429 | A1 * | 3/2011 | Shperling et al. | 704/228 |

FOREIGN PATENT DOCUMENTS

| | | | |
|---|---|---|---|
| JP | 2004-510209 | A | 4/2004 |
| JP | 2005-017932 | A | 1/2005 |

(Continued)

OTHER PUBLICATIONS

Notification of Reasons for Refusal, dated Mar. 12, 2013, issued by the Japanese Patent Office in counterpart Japanese Application No. 2010-542839.

*Primary Examiner* — Daniel D Abebe
(74) *Attorney, Agent, or Firm* — Sughrue Mion, PLLC

(57) ABSTRACT

Judgment result deriving means 74 makes a judgment between active voice and non-active voice every unit time for a time series of voice data in which the number of active voice segments and the number of non-active voice segments are already known as a number of the labeled active voice segment and a number of the labeled non-active voice segment and shapes active voice segments and non-active voice segments as the result of the judgment by comparing the length of each segment during which the voice data is consecutively judged to correspond to active voice by the judgment or the length of each segment during which the voice data is consecutively judged to correspond to non-active voice by the judgment with a duration threshold. Segments number calculating means 75 calculates the number of active voice segments and the number of non-active voice segments. Duration threshold updating means 76 updates the duration threshold so that the difference between the calculated number of active voice segments and the number of the labeled active voice segments decreases or the difference between the calculated number of non-active voice segments and the number of the labeled non-active voice segments decreases.

19 Claims, 10 Drawing Sheets

(56) References Cited

FOREIGN PATENT DOCUMENTS

| | | | |
|---|---|---|---|
| JP | 2006-209069 | A | 8/2006 |
| JP | 2007-017620 | A | 1/2007 |
| JP | 2008-151840 | A | 7/2008 |
| JP | 2008-170789 | A | 7/2008 |
| JP | 2008242082 | A | 10/2008 |
| WO | 02/27711 | A1 | 4/2002 |

* cited by examiner

VOICE ACTIVITY DETECTOR, VOICE ACTIVITY DETECTION PROGRAM, AND PARAMETER ADJUSTING METHOD

This application is a National Stage of International Application No. PCT/JP2009/006666 filed Dec. 7, 2009, claiming priority based on Japanese Patent Application No. 2008-321551 filed Dec. 17, 2008, the contents of all of which are incorporated herein by reference in their entirety.

TECHNICAL FIELD

The present invention relates to a voice activity detector, a voice activity detection program and a parameter adjusting method. In particular, the present invention relates to a voice activity detector and a voice activity detection program for discriminating between active voice segments and non-active voice segments in an input signal, and a parameter adjusting method employed for such a voice activity detector.

BACKGROUND ART

Voice activity detection technology is widely used for various purposes. For example, the voice activity detection technology is used in mobile communications, etc. for improving the voice transmission efficiency by increasing the compression ratio of the non-active voice segments or by precisely leaving out transmission of the non-active voice segments. Further, the voice activity detection technology is widely used in noise cancellers, echo cancellers, etc. for estimating or determining the noise level in the non-active voice segments, in sound recognition systems (voice recognition systems) for improving the performance and reducing the workload, etc.

Various devices for detecting the active voice segments have been proposed (see Patent Documents 1 and 2, for example). An active voice segment detecting device described in the Patent Document 1 extracts active voice frames, calculates a first fluctuation (first variance) by smoothing the voice level, calculates a second fluctuation (second variance) by smoothing fluctuations in the first fluctuation, and judges whether each frame is an active voice frame or a non-active voice frame by comparing the second fluctuation with a threshold value. Further, the active voice segment detecting device determines active voice segments (based on the duration of active voice/non-active voice frames) according to the following judgment conditions:

Condition (1): An active voice segment that did not satisfy a minimum necessary duration is not accepted as an active voice segment. The minimum necessary duration will hereinafter be referred to as an "active voice duration threshold".

Condition (2): A non-active voice segment sandwiched between active voice segments and satisfying (shorter than) duration for being handled as a continuous active voice segment is integrated with the active voice segments at both ends to make one active voice segment. The "duration for being handled as a continuous active voice segment" will hereinafter be referred to as a "non-active voice duration threshold" since the segment is regarded as a non-active voice segment if its duration is the non-active voice duration threshold or longer.

Condition (3): A prescribed number of frames adjoining the starting/finishing end of an active voice segment and having been judged as non-active voice segments due to their low fluctuation values are added to the active voice segment.

The prescribed number of frames added to the active voice segment will hereinafter be referred to as "starting/finishing end margins".

In the active voice segment detecting device described in the Patent Document 1, the threshold value used for the judgment on whether each frame is an active voice frame or a non-active voice frame and the parameters (active voice duration threshold, non-active voice duration threshold, etc.) regarding the above conditions are previously set values.

Meanwhile, an active voice segment detection device described in the Patent Document 2 employs the amplitude level of the active voice waveform, a zero crossing number (how many times the signal level crosses 0 in a prescribed time period), spectral information on the sound signal, a GMM (Gaussian Mixture Model) log likelihood, etc. as voice feature quantities.

CITATION LIST

Patent Literature

Patent Document 1 JP-A-2006-209069
Patent Document 2 JP-A-2007-17620

SUMMARY OF INVENTION

Technical Problem

In the case where the active voice segments based on the duration of active voice/non-active voice frames are determined using the conditions (1), (2), etc. described in the Patent Document 1, the parameters specified in the conditions (1), (2), etc. do not necessarily have values suitable for noise conditions (e.g., the type of noise) and recording conditions for the input signal (e.g., properties of the microphone and performance of the A/D board). If the parameters specified in the conditions (1), (2), etc. are not at the values suitable for the noise conditions and the recording conditions in the use of the active voice segment detecting device, the accuracy of the segment determination based on the conditions (1), (2), etc. deteriorates.

It is therefore the primary object of the present invention to provide a voice activity detector, a voice activity detection program and a parameter adjusting method capable of increasing the accuracy of the judgment result after undergoing shaping in cases where a judgment on whether each frame of an input signal corresponds to an active voice segment or a non-active voice segment is made and the judgment result is shaped according to prescribed rules.

Solution to Problem

A voice activity detector in accordance with the present invention comprises: judgment result deriving means which makes a judgment between active voice and active voice every unit time for a time series of voice data in which the number of active voice segments and the number of non-active voice segments are already known as a number of the labeled active voice segment and a number of the labeled non-active voice segment, the judgment result deriving means shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment; segment number calculating means which calculates the number of active voice segments and the number of non-active voice segments from the judgment result after the shaping; and duration threshold updating means which updates the duration threshold so that the difference between the number of active voice segments calculated by the segment number calculating means and the number of the labeled active voice segments decreases or the difference between the number of non-active voice segments calculated by the segment number calculating means and the number of the labeled non-active voice segments decreases.

A parameter adjusting method in accordance with the present invention comprises the steps of: making a judgment between active voice and non-active voice every unit time for a time series of voice data in which the number of active voice segments and the number of non-active voice segments are already known as a number of the labeled active voice segment and a number of the labeled non-active voice segment, and shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment; calculating the number of active voice segments and the number of non-active voice segments from the judgment result after the shaping; and updating the duration threshold so that the difference between the number of active voice segments calculated from the judgment result after the shaping and the number of the labeled active voice segments decreases or the difference between the number of non-active voice segments calculated from the judgment result after the shaping and the number of the labeled non-active voice segments decreases.

A voice activity detection program in accordance with the present invention causes a computer to execute: a judgment result deriving process of making a judgment between active voice and non-active voice every unit time for a time series of voice data in which the number of active voice segments and the number of non-active voice segments are already known as a number of the labeled active voice segment and a number of the labeled non-active voice segment, and shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment; a segment number calculating process of calculating the number of active voice segments and the number of non-active voice segments from the judgment result after the shaping; and a duration threshold updating process of updating the duration threshold so that the difference between the number of active voice segments calculated by the segment number calculating process and the number of the labeled active voice segments decreases or the difference between the number of non-active voice segments calculated by the segment number calculating process and the number of the labeled non-active voice segments decreases.

Advantageous Effects of the Invention

With the present invention, the accuracy of the judgment result after the shaping can be increased in cases where a judgment on whether each frame of an input signal corresponds to an active voice segment or a non-active voice segment is made and the judgment result is shaped according to prescribed rules.

DESCRIPTION OF EMBODIMENTS

Figure 1:
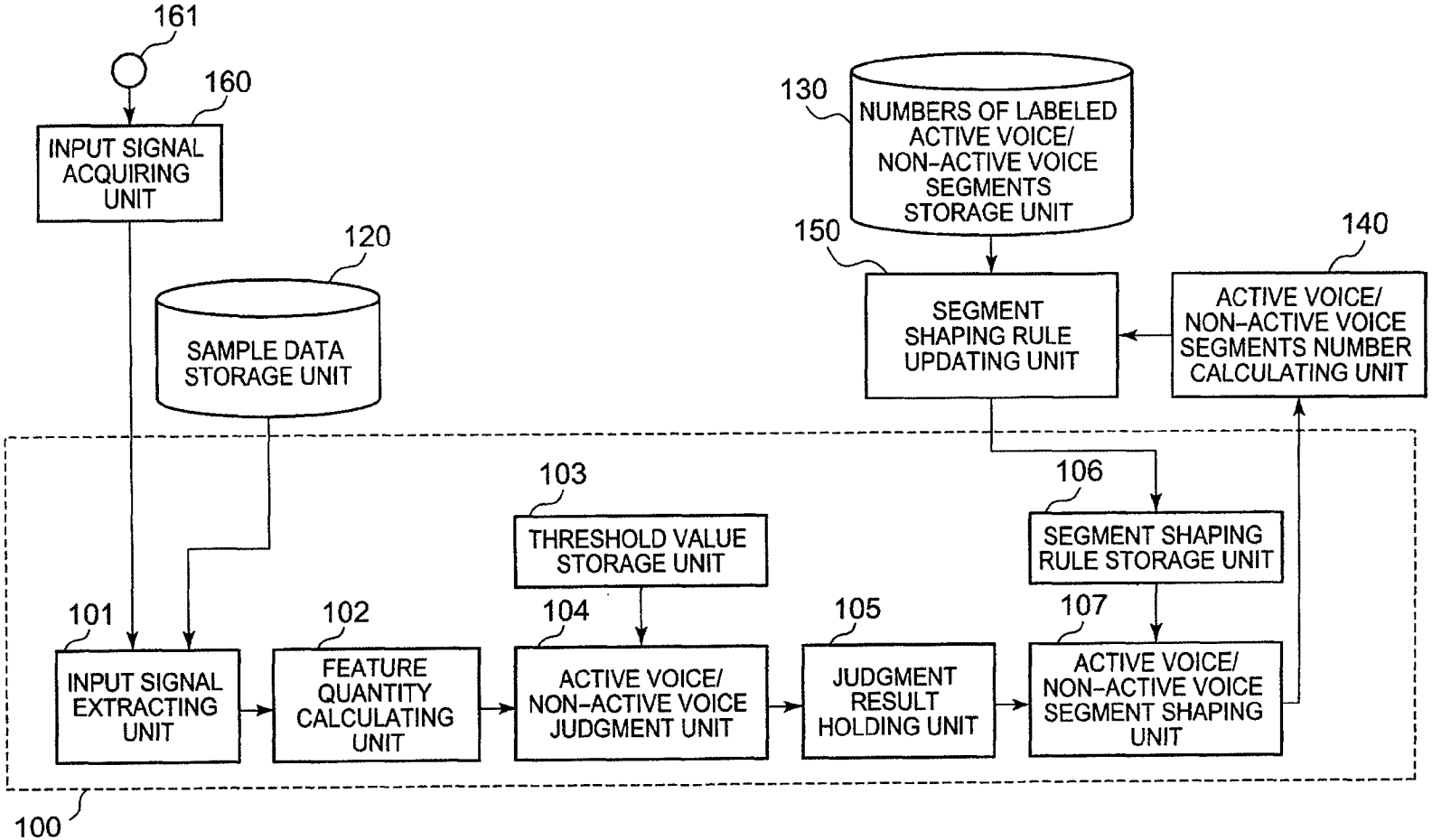
FIG. 1 It depicts a block diagram showing an example of the configuration of a voice activity detector in accordance with a first embodiment of the present invention.

Referring now to the drawings, a description will be given in detail of preferred embodiments in accordance with the present invention. Incidentally, the voice activity detector in accordance with the present invention can be referred to also as a "active voice segment discriminating device" since the device discriminates between active voice segments and non-active voice segments in a sound signal inputted to the device.

First Embodiment

FIG. 1 is a block diagram showing an example of the configuration of a voice activity detector in accordance with a first embodiment of the present invention. The voice activity detector of the first embodiment includes a voice activity detection unit 100, a sample data storage unit 120, a numbers of labeled active voice/non-active voice segments storage unit 130, an active voice/non-active voice segments number calculating unit 140, a segment shaping rule updating unit 150 and an input signal acquiring unit 160.

The voice activity detector in accordance with the present invention extracts frames from an inputted sound signal and judges whether each of the frames corresponds to an active voice segment or a non-active voice segment. Further, the voice activity detector shapes the result of the judgment according to rules for shaping the judgment result (segment shaping rules) and outputs the judgment result after the shaping. Meanwhile, the voice activity detector makes the judgment (on whether each frame corresponds to an active voice segment or a non-active voice segment) also for previously prepared sample data in which whether each frame is an active voice segment or a non-active voice segment has already been determined in order of the time series, shapes the judgment result according to the segment shaping rules, and sets parameters included in the segment shaping rules by referring to the judgment result after the shaping. In the judgment process for the inputted sound signal, the judgment result is shaped based on the parameters.

The "segment" means a part of the sample data or the inputted sound signal corresponding to one time period in which a state with active voice or a state without active voice continues. Thus, the "active voice segment" means a part of the sample data or the inputted sound signal corresponding to one time period in which a state with active voice continues, and the "non-active voice segment" means a part of the sample data or the inputted sound signal corresponding to one time period in which a state without active voice continues. The active voice segments and non-active voice segments appear alternately. The expression "a frame is judged to correspond to an active voice segment" means that the frame is judged to be included in an active voice segment, and the expression "a frame is judged to correspond to a non-active voice segment" means that the frame is judged to be included in a non-active voice segment.

The voice activity detection unit 100 makes the judgment (discrimination) between active voice segments and non-active voice segments in the sample data or the inputted sound signal and shapes the result of the judgment. The voice activity detection unit 100 includes an input signal extracting unit 101, a feature quantity calculating unit 102, a threshold value storage unit 103, an active voice/non-active voice judgment unit 104, a judgment result holding unit 105, a segment shaping rule storage unit 106 and an active voice/non-active voice segment shaping unit 107.

The input signal extracting unit 101 successively extracts waveform data of each frame (for a unit time) from the sample data or the inputted sound signal in order of time. In other words, the input signal extracting unit 101 extracts frames from the sample data or the sound signal. The length of the unit time may be set previously.

The feature quantity calculating unit 102 calculates a voice feature quantity in regard to each frame extracted by the input signal extracting unit 101.

The threshold value storage unit 103 stores a threshold value to be used for the judgment on whether each frame corresponds to an active voice segment or a non-active voice segment (hereinafter referred to as a "judgment threshold value"). The judgment threshold value is previously stored in the threshold value storage unit 103. In the following explanation, the judgment threshold value is represented as "θ".

The active voice/non-active voice judgment unit 104 makes the judgment on whether each frame corresponds to an active voice segment or a non-active voice segment by comparing the feature quantity calculated by the feature quantity calculating unit 102 with the judgment threshold value θ. In other words, the active voice/non-active voice judgment unit 104 judges whether each frame is a frame included in an active voice segment or a frame included in a non-active voice segment.

The judgment result holding unit 105 holds the result of the judgment on each frame across a plurality of frames.

The segment shaping rule storage unit 106 stores the segment shaping rules as rules for shaping the judgment result on whether each frame corresponds to an active voice segment or a non-active voice segment. The segment shaping rule storage unit 106 may store the following segment shaping rules, for example:

The first segment shaping rule is a rule specifying that "an active voice segment shorter than an active voice duration threshold is removed and integrated with non-active voice segments at front and rear ends to make one non-active voice segment". In other words, when the number (duration) of consecutive frames judged to correspond to active voice segments is less than the active voice duration threshold, the judgment results of the consecutive frames are changed to non-active voice segments.

The second segment shaping rule is a rule specifying that "a non-active voice segment shorter than a non-active voice duration threshold is removed and integrated with active voice segments at front and rear ends to make one active voice segment". In other words, when the number (duration) of consecutive frames judged to correspond to non-active voice segments is less than the non-active voice duration threshold, the judgment results of the consecutive frames are changed to active voice segments.

The segment shaping rule storage unit 106 may also store rules other than the above rules.

The parameters included in the segment shaping rules stored in the segment shaping rule storage unit 106 are successively updated by the segment shaping rule updating unit 150 from values in the initial state (initial values).

The active voice/non-active voice segment shaping unit 107 shapes the judgment result across a plurality of frames according to the segment shaping rules stored in the segment shaping rule storage unit 106.

The sample data storage unit 120 stores the sample data as voice data to be used for learning the parameters included in the segment shaping rules. Here, the "learning" means appropriately setting the parameters included in the segment shaping rules. The sample data may also be called "learning data" for the learning of the parameters included in the segment shaping rules. Concretely, the parameters included in the segment shaping rules can be the active voice duration threshold and the non-active voice duration threshold, for example.

Figure 2:
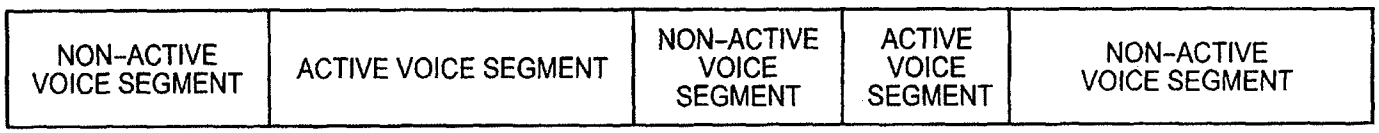
FIG. 2 It depicts a schematic diagram showing an example of active voice segments and non-active voice segments in sample data.

The numbers of labeled active voice/non-active voice segments storage unit 130 stores the numbers of active voice segments and non-active voice segments previously determined in the sample data. The number of the active voice segments previously determined in the sample data will hereinafter be referred to as a "number of the labeled active voice segments", and the number of the non-active voice segments previously determined in the sample data will hereinafter be referred to as a "number of the labeled non-active voice segments". For example, when the active voice segments and non-active voice segments have been determined in the sample data as illustrated in FIG. 2, numbers "2" and "3" are stored in the numbers of labeled active voice/non-active voice segments storage unit 130 as the number of the labeled active voice segments and the number of the labeled non-active voice segments, respectively.

The active voice/non-active voice segments number calculating unit 140 obtains an active voice segment number (the number of active voice segments) and a non-active voice segment number (the number of non-active voice segments) from the judgment result on the sample data after the shaping by the active voice/non-active voice segment shaping unit 107 when the judgment has been made for the sample data.

The segment shaping rule updating unit 150 updates the parameters of the segment shaping rules (the active voice duration threshold and the non-active voice duration threshold) based on the number of the active voice segments and the number of the non-active voice segments obtained by the active voice/non-active voice segments number calculating unit 140 and the number of the labeled active voice segments and the number of the labeled non-active voice segments stored in the numbers of labeled active voice/non-active voice segments storage unit 130. The segment shaping rule updating unit 150 may execute the update by just updating parts of the segment shaping rules (stored in the segment shaping rule storage unit 106) that specify the values of the parameters.

The input signal acquiring unit 160 converts an analog signal of inputted voice into a digital signal and inputs the digital signal to the input signal extracting unit 101 of the voice activity detection unit 100 as the sound signal. The input signal acquiring unit 160 may acquire the sound signal (analog signal) via a microphone 161, for example. The sound signal may of course be acquired by a different method.

The input signal extracting unit 101, the feature quantity calculating unit 102, the active voice/non-active voice judgment unit 104, the active voice/non-active voice segment shaping unit 107, the active voice/non-active voice segments number calculating unit 140 and the segment shaping rule updating unit 150 may be implemented by separate hardware modules, or by a CPU operating according to a program (voice activity detection program). Specifically, the CPU may load the program previously stored in program storage means (not illustrated) of the voice activity detector and operate as the input signal extracting unit 101, feature quantity calculating unit 102, active voice/non-active voice judgment unit 104, active voice/non-active voice segment shaping unit 107, active voice/non-active voice segments number calculating unit 140 and segment shaping rule updating unit 150 according to the loaded program.

The threshold value storage unit 103, the judgment result holding unit 105, the segment shaping rule storage unit 106, the sample data storage unit 120 and the numbers of labeled active voice/non-active voice segments storage unit 130 are implemented by a storage device, for example. The type of the storage device is not particularly restricted. The input signal acquiring unit 160 is implemented by, for example, an A/D converter or a CPU operating according to a program.

Next, the sample data will be explained. While voice data like 16-bit Linear-PCM (Pulse Code Modulation) data can be taken as an example of the sample data stored in the sample data storage unit 120, other types of voice data may also be used. The sample data is desired to be voice data recorded in a noise environment in which the voice activity detector is supposed to be used. However, when such a noise environment can not be specified, voice data recorded in multiple noise environments may also be used as the sample data. It is also possible to record clean voice (including no noise) and noise separately, create data with a computer by superposing the clean voice on the noise, and use the created data as the sample data.

The number of the labeled active voice segments and the number of the labeled non-active voice segments are previously determined for the sample data and stored in the numbers of labeled active voice/non-active voice segments storage unit 130. The number of the labeled active voice segments and the number of the labeled non-active voice segments may be determined by a human by listening to voice according to the sample data, judging (discriminating) between active voice segments and non-active voice segments in the sample data, and counting the numbers of active voice segments and non-active voice segments. The number of the labeled active voice segments and the number of the labeled non-active voice segments may also be determined (counted) automatically, by automatically labeling each segment in the sample data as an active voice segment or a non-active voice segment by executing a sound recognition process (voice recognition process) to the sample data. In the case where the sample data is obtained by superposing clean voice on noise, the labeling between active voice segments and non-active voice segments may be conducted by executing a separate voice detection process (according to a standard sound detection technique) to the clean voice.

In the following, the operation will be described.

Figure 3:
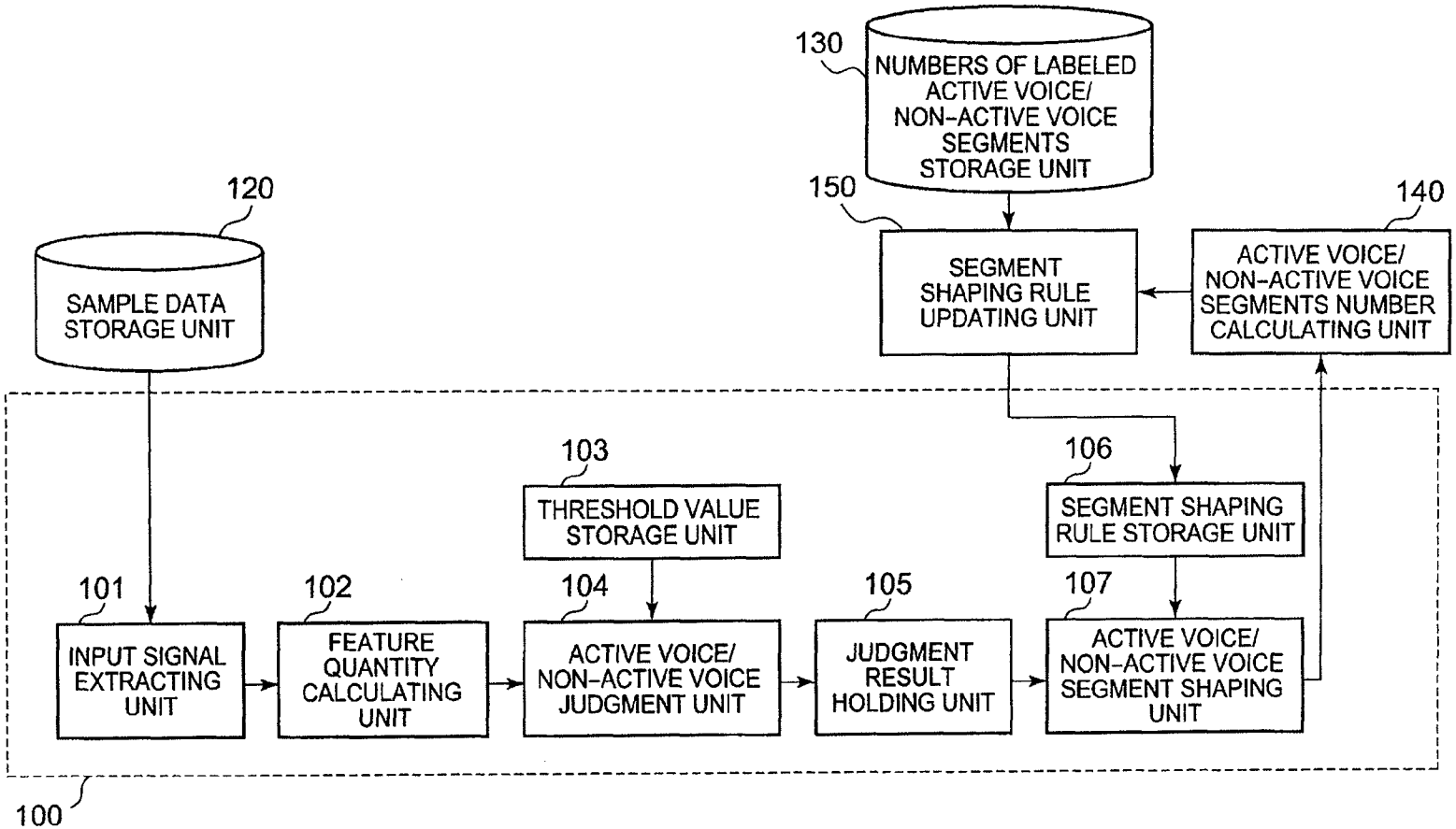
FIG. 3 It depicts a block diagram showing a part of the components of the voice activity detector of the first embodiment relating to a learning process.
Figure 4:
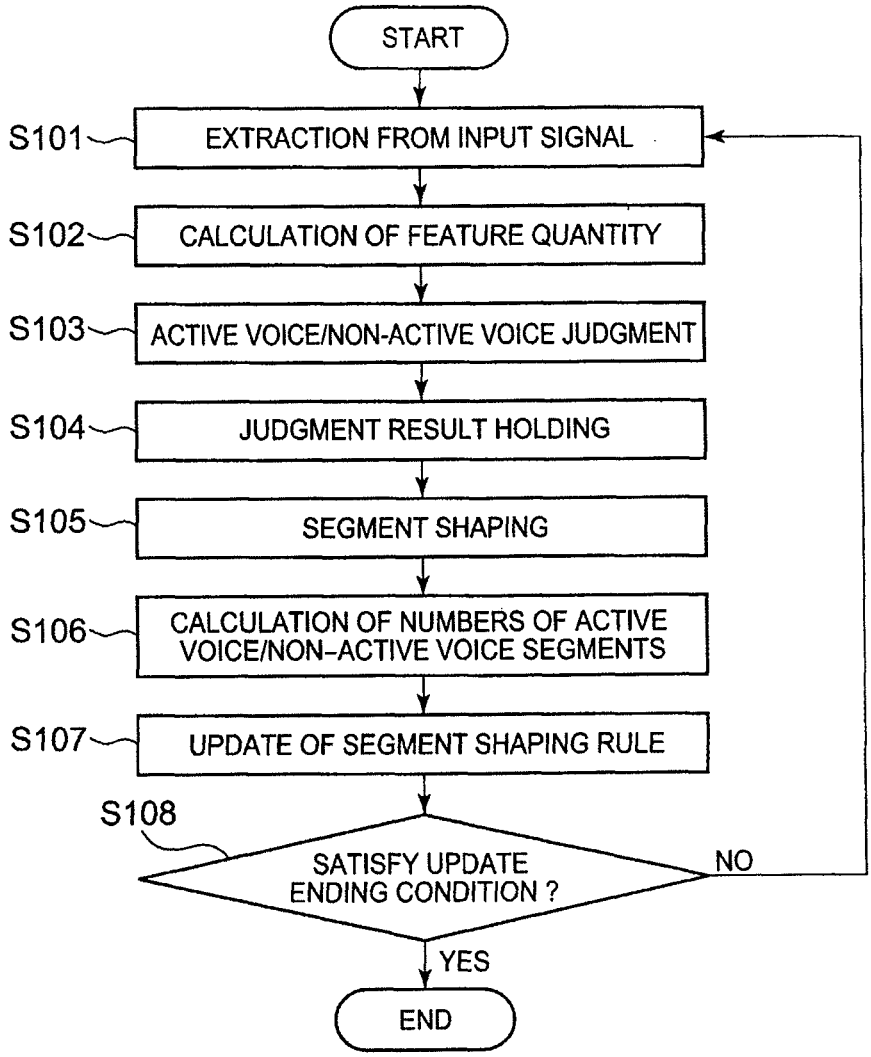
FIG. 4 It depicts a flow chart showing an example of the progress of the learning process.

FIG. 3 is a block diagram showing a part of the components of the voice activity detector of the first embodiment relating to a learning process for the learning of the parameters (the active voice duration threshold and the non-active voice duration threshold) included in the segment shaping rules. FIG. 4 is a flow chart showing an example of the progress of the learning process. The operation of the learning process will be explained below referring to FIGS. 3 and 4.

First, the input signal extracting unit 101 reads out the sample data stored in the sample data storage unit 120 and extracts the waveform data of each frame (for the unit time) from the sample data in order of the time series (step S101). For example, the input signal extracting unit 101 may successively extract the waveform data of each frame (for the unit time) while successively shifting the extraction target part (as the target of the extraction from the sample data) by a prescribed time. The unit time and the prescribed time will hereinafter be referred to as a "frame width" and a "frame shift", respectively. For example, when the sample data stored in the sample data storage unit 120 is 16-bit Linear-PCM voice data with a sampling frequency of 8000 Hz, the sample data includes waveform data of 8000 points per second. In this case, the input signal extracting unit 101 may, for example, successively extract waveform data having a frame width of 200 points (25 msec) from the sample data in order of the time series with a frame shift of 80 points (10 msec), that is, successively extract waveform data of 25 msec frames from the sample data while successively shifting the extraction target part by 10 msec. Incidentally, the type of the sample data and the values of the frame width and the frame shift are not restricted to the above example used just for illustration.

Subsequently, the feature quantity calculating unit 102 calculates the feature quantity of each piece of waveform data successively extracted from the sample data for the frame width by the input signal extracting unit 101 (step S102). The feature quantity calculated in this step S102 may be, for example, data obtained by smoothing fluctuations in the spectrum power (sound level) and further smoothing fluctuations in the result of the smoothing (i.e., data corresponding to the second fluctuation in the Patent Documents 1) or data selected from the amplitude level of the sound waveform, the spectral information on the sound signal, the zero crossing number (zero point crossing number), the GMM log likelihood, etc. described in the Patent Document 2. It is also possible to calculate a feature quantity by mixing multiple types of feature quantities. Incidentally, these feature quantities are just an example and a different feature quantity may be calculated in the step S102.

Subsequently, the active voice/non-active voice judgment unit 104 judges whether each frame corresponds to an active voice segment or a non-active voice segment by comparing the feature quantity calculated in the step S102 with the judgment threshold value θ stored in the threshold value storage unit 103 (step S103). For example, the active voice/non-active voice judgment unit 104 judges that the frame corresponds to an active voice segment if the calculated feature quantity is greater than the judgment threshold value θ while judging that the frame corresponds to a non-active voice segment if the feature quantity is the judgment threshold value θ or less. Incidentally, there can be a feature quantity that takes on low values in active voice segments and high values in non-active voice segments. In such cases, the active voice/non-active voice judgment unit 104 may judge that the frame corresponds to an active voice segment if the feature quantity is less than the judgment threshold value θ while judging that the frame corresponds to a non-active voice segment if the feature quantity is the judgment threshold value θ or more. The judgment threshold value θ may previously be set properly depending on the type of the feature quantity calculated in the step S102.

The active voice/non-active voice judgment unit 104 makes the judgment result holding unit 105 hold the judgment result (whether each frame corresponds to an active voice segment or a non-active voice segment) across a plurality of frames (step S104). The judgment result can be held (stored) in the judgment result holding unit 105 in various styles. For example, a label representing an active voice segment or a non-active voice segment may be assigned to each frame and stored in the judgment result holding unit 105, or the storing may be conducted for each segment. For example, the judgment result holding unit 105 may store information representing the belonging to the same active voice segment in regard to consecutive frames judged as active voice segments, and information representing the belonging to the same non-active voice segment in regard to consecutive frames judged as non-active voice segments. It is desirable that the number of the frames, for which the result of the judgment between active voice segments and non-active voice segments should be held in the judgment result holding unit 105, be changeable. The judgment result holding unit 105 may be configured to hold the judgment result for frames corresponding to an entire utterance, or for frames for several seconds, for example.

Subsequently, the active voice/non-active voice segment shaping unit 107 shapes the judgment result held by the judgment result holding unit 105 according to the segment shaping rules (step S105).

According to the aforementioned first segment shaping rule, for example, when the number (duration) of consecutive frames judged to correspond to active voice segments is less than the active voice duration threshold, the active voice/non-active voice segment shaping unit 107 changes the judgment results of the consecutive frames to non-active voice segments, that is, to judgment results indicating that the frames correspond to non-active voice segments. Consequently, the active voice segment, whose number (duration) of consecutive frames is less than the active voice duration threshold, is removed and integrated with non-active voice segments at front and rear ends to make one non-active voice segment.

According to the aforementioned second segment shaping rule, for example, when the number (duration) of consecutive frames judged to correspond to non-active voice segments is less than the non-active voice duration threshold, the active voice/non-active voice segment shaping unit 107 changes the judgment results of the consecutive frames to active voice segments, that is, to judgment results indicating that the frames correspond to active voice segments. Consequently, the non-active voice segment, whose number (duration) of consecutive frames is less than the non-active voice duration threshold, is removed and integrated with active voice segments at front and rear ends to make one active voice segment.

Figure 5:
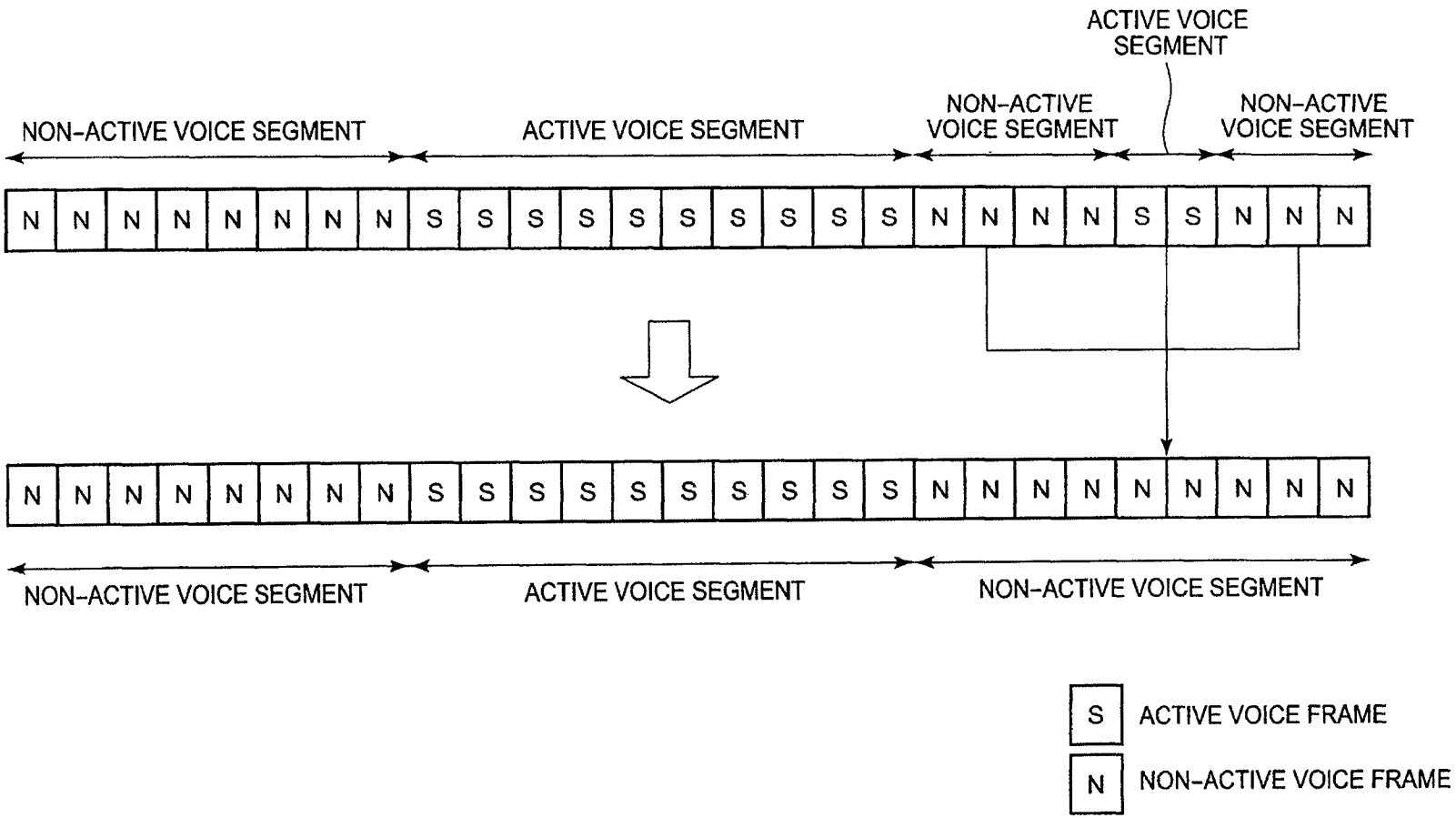
FIG. 5 It depicts an explanatory drawing showing an example of shaping of judgment result.

FIG. 5 is an explanatory drawing showing an example of the shaping of the judgment result. In FIG. 5, "S" represents a frame judged to correspond to an active voice segment and "N" represents a frame judged to correspond to a non-active voice segment. The upper row of FIG. 5 shows the judgment result before the shaping and the lower row of FIG. 5 shows the judgment result after the shaping. Assuming that the active voice duration threshold is greater than 2, when the number of consecutive frames judged as active voice segments is 2, the number 2 is less than the active voice duration threshold and thus the active voice/non-active voice segment shaping unit 107 shapes the judgment result for the two consecutive frames to non-active voice segments according to the first segment shaping rule. Consequently, the part under consideration, an active voice segment before the shaping, is integrated with non-active voice segments at front and rear ends to make one non-active voice segment as shown in the lower row of FIG. 5. While an example of the shaping according to the first segment shaping rule is shown in FIG. 5, the shaping according to the second segment shaping rule is also executed similarly.

In this step S105, the shaping is executed according to the segment shaping rules stored (existing) in the segment shaping rule storage unit 106 at the point in time. When the process advances to the step S105 for the first time, for example, the shaping is carried out using the initial values of the active voice duration threshold and non-active voice duration threshold.

After the step S105, the active voice/non-active voice segments number calculating unit 140 calculates the number of the active voice segments and the number of the non-active voice segments by referring to the result of the shaping (step S106). The active voice/non-active voice segments number calculating unit 140 regards a set of one or more frames consecutively judged as active voice segments as one active voice segment and obtains the number of the active voice segments by counting the number of such frame sets (active voice segments). In the example shown in the lower row of FIG. 5, for example, the number of the active voice segments is calculated as 1 since there exists one frame set composed of one or more frames consecutively judged as active voice segments. Similarly, the active voice/non-active voice segments number calculating unit 140 regards a set of one or more frames consecutively judged as non-active voice segments as one non-active voice segment and obtains the number of the non-active voice segments by counting the number of such frame sets (non-active voice segments). In the example shown in the lower row of FIG. 5, for example, the number of the non-active voice segments is calculated as 2 since there exist two frame sets composed of one or more frames consecutively judged as non-active voice segments.

Subsequently, the segment shaping rule updating unit 150 updates the active voice duration threshold and the non-active voice duration threshold based on the number of the active voice segments and the number of the non-active voice segments obtained in the step S105 and the number of the labeled active voice segments and the number of the labeled non-active voice segments stored in the numbers of labeled active voice/non-active voice segments storage unit 130 (step S107).

The segment shaping rule updating unit 150 updates the active voice duration threshold (hereinafter represented as "$\theta^{ACTIVE\ VOICE}$") according to the following expression (1):

$$\theta^{ACTIVE\ VOICE} \leftarrow \theta^{ACTIVE\ VOICE} - \epsilon \times (\text{number of the labeled active voice segments} - \text{number of the active voice segments}) \quad (1)$$

The character "$\theta^{ACTIVE\ VOICE}$" on the left side of the expression (1) represents the active voice duration threshold after the update, while "$\theta^{ACTIVE\ VOICE}$" on the right side represents the active voice duration threshold before the update. Thus, the segment shaping rule updating unit 150 may calculate $\theta^{ACTIVE\ VOICE} - \epsilon \times$(number of the labeled active voice segments−number of the active voice segments) using the active voice duration threshold $\theta^{ACTIVE\ VOICE}$ before the update and then regard the calculation result as the active voice duration threshold after the update. The character "ϵ" in the expression (1) represents the step size of the update. In other words, ϵ is a value specifying the magnitude of the update of $\theta^{ACTIVE\ VOICE}$ in one execution of the step S107.

Meanwhile, the segment shaping rule updating unit 150 updates the non-active voice duration threshold (hereinafter represented as "$\theta^{NON\text{-}ACTIVE\ VOICE}$") according to the following expression (2):

$$\theta^{NON\text{-}ACTIVE\ VOICE} \leftarrow \theta^{NON\text{-}ACTIVE\ VOICE} - \epsilon' \times (\text{number of the labeled non-active voice segments} - \text{number of the non-active voice segments}) \quad (2)$$

The character "$\theta^{NON\text{-}ACTIVE\ VOICE}$" on the left side of the expression (2) represents the non-active voice duration threshold after the update, while "$\theta^{NON\text{-}ACTIVE\ VOICE}$" on the right side represents the non-active voice duration threshold before the update. Thus, the segment shaping rule updating unit 150 may calculate $\theta^{NON\text{-}ACTIVE\ VOICE} - \epsilon' \times$(number of the labeled non-active voice segments−number of the non-active voice segments) using the non-active voice duration threshold $\theta^{NON\text{-}ACTIVE\ VOICE}$ before the update and then regard the calculation result as the non-active voice duration threshold after the update. The character "ϵ" in the expression (2) represents the step size of the update, that is, a value specifying the magnitude of the update of $\theta^{NON\text{-}ACTIVE\ VOICE}$ in one execution of the step S107.

It is possible to use a fixed value as the step size (ϵ, ϵ'), or to initially set the step size (ϵ, ϵ') at a high value and gradually decrease the value of step size (ϵ, ϵ').

Subsequently, the segment shaping rule updating unit 150 judges whether an ending condition for the update of the active voice duration threshold and the non-active voice duration threshold is satisfied or not (step S108). If the update ending condition is satisfied ("Yes" in step S108), the learning process is ended. If the update ending condition is not satisfied ("No" in step S108), the process from the step S101 is repeated. In the step S105 in this case, the shaping of the judgment result is executed based on the active voice duration threshold and the non-active voice duration threshold updated in the immediately preceding step S107. As an example of the update ending condition, a condition that "the changes in the active voice duration threshold and the non-active voice duration threshold caused by the update are less than a preset value" may be used, that is, the segment shaping rule updating unit 150 may judge whether the condition "the changes in the active voice duration threshold and the non-active voice duration threshold caused by the update (the difference between the active voice duration threshold after the update and that before the update and the difference between the non-active voice duration threshold after the update and that before the update) are less than a preset value" is satisfied or not. It is also possible to employ a condition that the learning has been conducted using the entire sample data a prescribed number of times (i.e., a condition that the process from S101 to S108 has been executed a prescribed number of times).

The update of the parameters by the expressions (1) and (2) is based on the theory of the steepest descent method. The parameter update may also be executed by a method other than the expressions (1) and (2) as long as the method is capable of reducing the difference between the number of the labeled active voice segments and the number of the active voice segments and the difference between the number of the labeled non-active voice segments and the number of the non-active voice segments.

Figure 6:
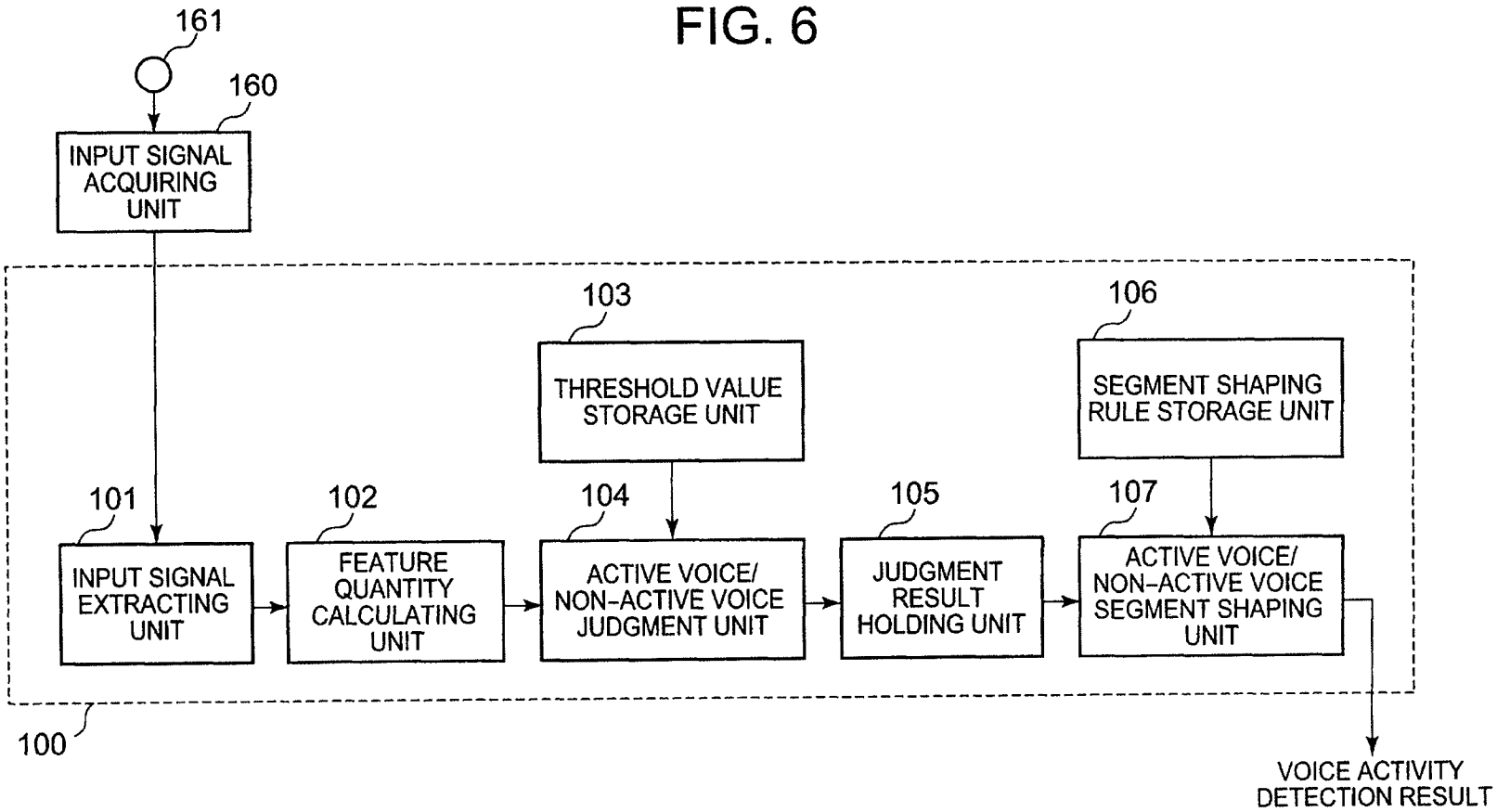
FIG. 6 It depicts a block diagram showing a part of the components of the voice activity detector of the first embodiment relating to a judgment on whether each frame of an inputted sound signal is an active voice segment or a non-active voice segment.

FIG. 6 is a block diagram showing a part of the components of the voice activity detector of the first embodiment relating to the judgment on whether each frame of the inputted sound signal is an active voice segment or a non-active voice segment. The judgment process after the learning of the active voice duration threshold and the non-active voice duration threshold will be explained below referring to FIG. 4.

First, the input signal acquiring unit 160 acquires the analog signal of the voice as the target of the judgment (discrimination) between active voice segments and non-active voice segments, converts the analog signal into the digital signal, and inputs the digital signal to the voice activity detection unit 100. The acquisition of the analog signal may be made using the microphone 161 or the like, for example. Upon input of the sound signal, the voice activity detection unit 100 executes a process similar to the steps S101-S105 (see FIG. 4) to the sound signal and thereby outputs the judgment result after the shaping.

Specifically, the input signal extracting unit 101 extracts the waveform data of each frame from the inputted voice data and the feature quantity calculating unit 102 calculates the feature quantity of each frame (step S102). Subsequently, the active voice/non-active voice judgment unit 104 judges whether each frame corresponds to an active voice segment or a non-active voice segment by comparing the feature quantity with the judgment threshold value (step S103) and then makes the judgment result holding unit 105 hold the judgment result (step S104). The active voice/non-active voice segment shaping unit 107 shapes the judgment result according to the segment shaping rules stored in the segment shaping rule storage unit 106 (step S105) and outputs the judgment result after the shaping as the output data. The parameters (the active voice duration threshold and the non-active voice duration threshold) included in the segment shaping rules are values which have been determined by the learning by use of the sample data. The shaping of the judgment result is executed using the parameters.

Next, the effect of this embodiment will be explained.

The probability that a particular shaping result is obtained by the shaping of the judgment result of the active voice/non-active voice judgment unit 104 using the aforementioned segment shaping rules can be represented by the following expressions (3) and (4):

$$P(\{L_c\}; \theta^{ACTIVE\ VOICE}, \theta^{NON\text{-}ACTIVE\ VOICE}) = \frac{1}{Z}\exp\left[\sum_{c\in even}\{\gamma(L_c - \theta^{ACTIVE\ VOICE}) + M_c\} + \sum_{c\in odd}\{\gamma'(L_c - \theta^{NON\text{-}ACTIVE\ VOICE}) - M_c\}\right] \quad (3)$$

$$Z \equiv \sum_{\{L_c\}}\exp\left[\sum_{c\in even}\{\gamma(L_c - \theta^{ACTIVE\ VOICE}) + M_c\} + \sum_{c\in odd}\{\gamma'(L_c - \theta^{NON\text{-}ACTIVE\ VOICE}) - M_c\}\right] \quad (4)$$

In the expressions (3) and (4), the subscript "c" represents a segment and the character "$L_c$" represents the number of frames in a segment c. Assuming that the first segment is invariably a non-active voice segment, subsequent non-active voice segments appear invariably on odd numbers and subsequent active voice segments appear invariably on even numbers since active voice segments and non-active voice segments appear alternately. The symbol $\{L_c\}$ represents a series indicating how the input signal is segmented into active voice segments and non-active voice segments. Specifically, the $\{L_c\}$ is expressed by a series of numbers each indicating the number of frames included in an active voice segment or a non-active voice segment. For example, when $\{L_c\}=[3, 5, 2, 10, 8\}$, the $\{L_c\}$ means that a non-active voice segment continues for 3 frames and thereafter an active voice segment continues for 5 frames, a non-active voice segment continues for 2 frames, an active voice segment continues for 10 frames, and a non-active voice segment continues for 8 frames.

The notation "$P(\{L_c\}; \theta^{ACTIVE\ VOICE}, \theta^{NON\text{-}ACTIVE\ VOICE})$" on the left side of the expression (3) represents the probability that a shaping result $\{L_c\}$ is obtained when the active voice duration threshold and the non-active voice duration threshold $\theta^{ACTIVE\ VOICE}$ and $\theta^{NON\text{-}ACTIVE\ VOICE}$, respectively. In other words, the $P(\{L_c\}; \theta^{ACTIVE\ VOICE}, \theta^{NON\text{-}ACTIVE\ VOICE})$ represents the probability that the shaping of the judgment result of the active voice/non-active voice judgment unit 104 by use of the segment shaping rules results in $\{L_c\}$. The notation "c∈even" represents even-numbered segments (i.e., active voice segments), while the notation "c∈odd" represents odd-numbered segments (i.e., non-active voice segments).

The characters "γ" and "γ'" represent the degrees of reliability of the active voice detection performance. Specifically, "γ" represents the degree of reliability in regard to active voice segments and "γ'" represent the degree of reliability in regard to non-active voice segments. The degree of reliability is infinite if the result of the active voice detection is invariably correct, while the degree of reliability equals 0 if the result is totally unreliable.

The character "$M_c$" represents a value obtained by the following calculation (5) using the judgment threshold value θ and the feature quantity of each frame which has been used for the discrimination between an active voice segment and a non-active voice segment by the active voice/non-active voice judgment unit 104.

$$M_c = \sum_{t \in c} r(F_t - \theta) \tag{5}$$

In the expression (5), "t" represents a frame and "t∈c" represents each frame included in the segment c under consideration. The character "r" represents a parameter specifying which of the judgment on each frame or the segment shaping rules should be valued above the other. The parameter r takes on nonnegative values. The judgment on each frame is valued when the parameter r is greater than 1, while the segment shaping rules are valued when the parameter r is less than 1. The character "$F_t$" represents the feature quantity of the frame t, and "θ" represents the judgment threshold value.

By regarding the aforementioned expression (3) as a likelihood function, the log likelihood can be obtained as the following expression (6):

$$\begin{aligned} L &= \log P(\{L_c\}; \theta^{ACTIVE\ VOICE}, \theta^{NON\text{-}ACTIVE\ VOICE}) \\ &= \sum_{c \in even} \{\gamma(L_c - \theta^{ACTIVE\ VOICE}) + M_c\} + \\ &\quad \sum_{c \in odd} \{\gamma'(L_c - \theta^{NON\text{-}ACTIVE\ VOICE}) - M_c\} - \log Z \end{aligned} \tag{6}$$

The $\theta^{ACTIVE\ VOICE}$ and $\theta^{NON\text{-}ACTIVE\ VOICE}$ that maximize the expression (6) are obtained as the following expressions (7) and (8):

$$\frac{\partial}{\partial \theta_s} L = -\gamma \theta^{ACTIVE\ VOICE} N_{even} + \gamma \theta^{ACTIVE\ VOICE} E[N_{even}] = 0 \tag{7}$$

$$\frac{\partial}{\partial \theta_n} L = -\gamma' \theta^{NON\text{-}ACTIVE\ VOICE} N_{odd} + \gamma' \theta^{NON\text{-}ACTIVE\ VOICE} E[N_{odd}] = 0 \tag{8}$$

In the expressions (7) and (8), "$N_{even}$" represents the number of active voice segments and "$N_{odd}$" represents the number of non-active voice segments. Since the log likelihood of the correct active voice/non-active voice segments (i.e., the previously determined active voice segments and non-active voice segments) should be maximized, the $N_{even}$ and $N_{odd}$ are replaced with the number of the labeled active voice segments and the number of the labeled non-active voice segments, respectively. The notation "$E[N_{even}]$" represents the expected value of the number of active voice segments and "$E[N_{odd}]$" represents the expected value of the number of non-active voice segments. The $E[N_{even}]$ and $E[N_{odd}]$ are assumed to be replaced with the number of the active voice segments and the number of the non-active voice segments obtained by the active voice/non-active voice segments number calculating unit 140, respectively. The expressions (1) and (2) are expressions successively obtaining the expressions (7) and (8). The update by the expressions (1) and (2) is an update that increases the log likelihood of the correct active voice/non-active voice segments.

As above, the parameters (the active voice duration threshold and the non-active voice duration threshold) of the segment shaping rules can be set at appropriate values by updating the parameters using the expressions (1) and (2). Consequently, the accuracy of the judgment result obtained by shaping the judgment result of the active voice/non-active voice judgment unit 104 according to the segment shaping rules can be increased.

The fact that the expressions (1) and (2) are expressions successively obtaining the expressions (7) and (8) will be explained below taking the expression (7) as an example. The expression (7) can be transformed into the following expression (9):

$$\begin{aligned} \frac{\partial}{\partial \theta_s} L &= -\gamma \theta^{ACTIVE\ VOICE}(N_{even} - E[N_{even}]) \\ &= -\gamma \theta^{ACTIVE\ VOICE} \\ &\quad (\text{the number of the labeled active voice segments} - \\ &\quad \text{the number of the active voice segments}) \\ &= 0 \end{aligned} \tag{9}$$

In the steepest descent method, $\theta_s$ that maximizes L (minimizes −L) can be obtained by successively executing the following calculation (10):

$$\theta_s \leftarrow \theta_s + \varepsilon \frac{\partial L}{\partial \theta_s} \tag{10}$$

The character "ε" in the expression (10) represents the step size, that is, a value determining the magnitude of the update.

By substituting the expression (8) into the expression (10), the following expression (11) is obtained:

$$\theta_s \leftarrow \theta_s - \epsilon\gamma\theta^{ACTIVE\ VOICE} \text{(number of the labeled active voice segments−number of the active voice segments)} \quad (11)$$

Here, by redefining the step size $\epsilon$, the following expression (12) is obtained:

$$\theta_s \leftarrow \theta_s - \epsilon\text{(number of the labeled active voice segments−number of the active voice segments)} \quad (12)$$

While the above explanation has been given about the expression (7), the same goes for the expression (8).

Second Embodiment

Figure 7:
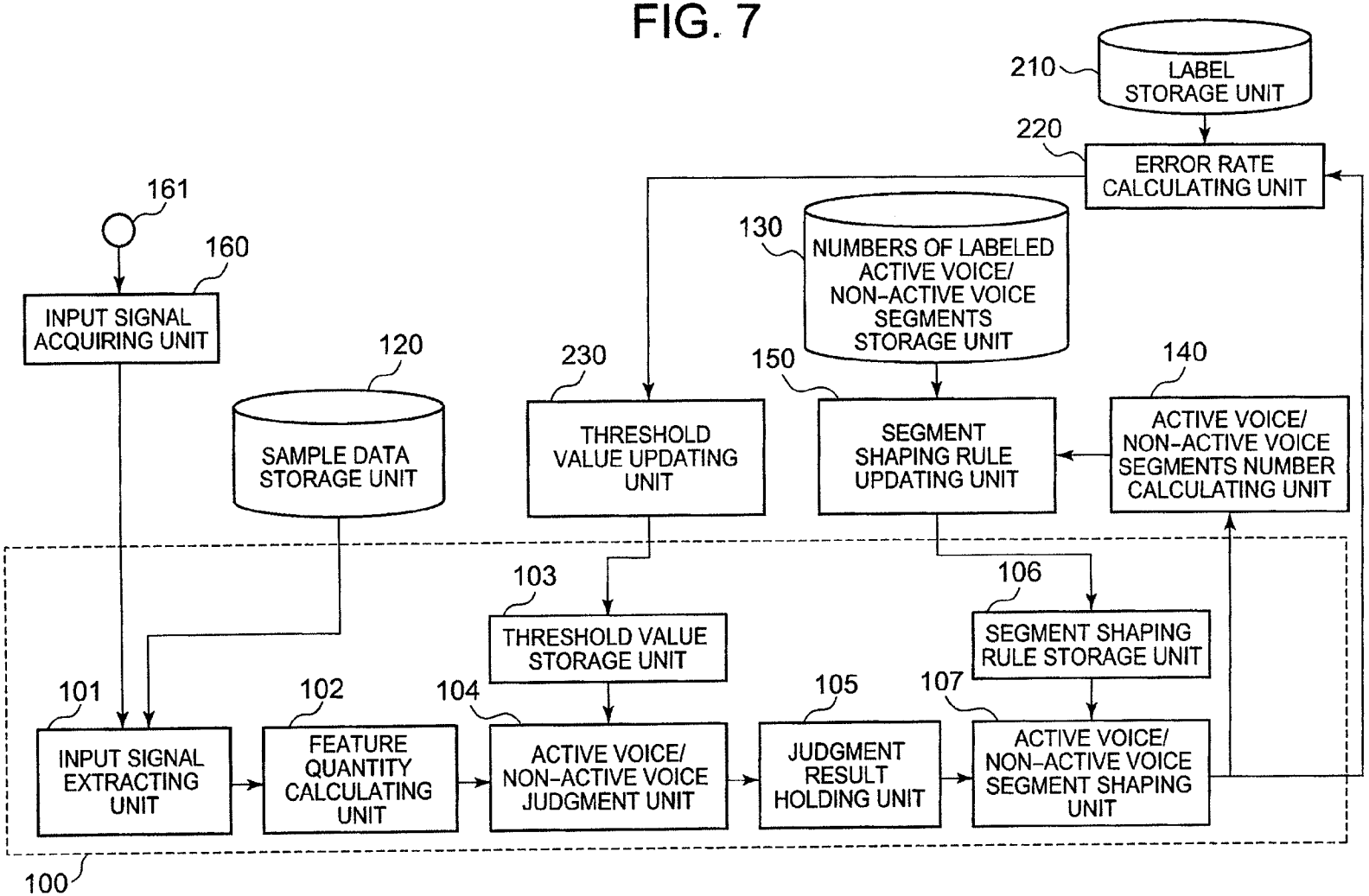
FIG. 7 It depicts a block diagram showing an example of the configuration of a voice activity detector in accordance with a second embodiment of the present invention.

FIG. 7 is a block diagram showing an example of the configuration of a voice activity detector in accordance with a second embodiment of the present invention, wherein components equivalent to those in the first embodiment are assigned the same reference characters as those in FIG. 1 and repeated explanation thereof is omitted for brevity. The voice activity detector of the second embodiment includes a label storage unit 210, an error rate calculating unit 220 and a threshold value updating unit 230 in addition to the configuration of the first embodiment. In this embodiment, learning of the judgment threshold value θ is also executed along with the learning of the parameters of the segment shaping rules.

The label storage unit 210 stores labels (regarding whether each frame corresponds to an active voice segment or a non-active voice segment) previously determined for the sample data. The labels are associated with the sample data in order of the time series. The judgment result for a frame is correct if the judgment result coincides with the label corresponding to the frame. If the judgment result does not coincide with the label, the judgment result for the frame is an error.

The error rate calculating unit 220 calculates error rates using the judgment result after the shaping by the active voice/non-active voice segment shaping unit 107 and the labels stored in the label storage unit 210. The error rate calculating unit 220 calculates the rate of misjudging an active voice segment as a non-active voice segment (FRR: False Rejection Rate) and the rate of misjudging a non-active voice segment as an active voice segment (FAR: False Acceptance Rate) as the error rates. More specifically, the FRR represents the rate of misjudging a frame that should be judged to correspond to an active voice segment as a frame corresponding to a non-active voice segment. Similarly, the FAR represents the rate of misjudging a frame that should be judged to correspond to a non-active voice segment as a frame corresponding to an active voice segment.

The threshold value updating unit 230 updates the judgment threshold value θ stored in the threshold value storage unit 103 based on the error rates.

The error rate calculating unit 220 and the threshold value updating unit 230 are implemented, for example, by a CPU operating according to a program, or as hardware separate from the other components. The label storage unit 210 is implemented by a storage device, for example.

Next, the operation of the second embodiment will be explained.

Figure 8:
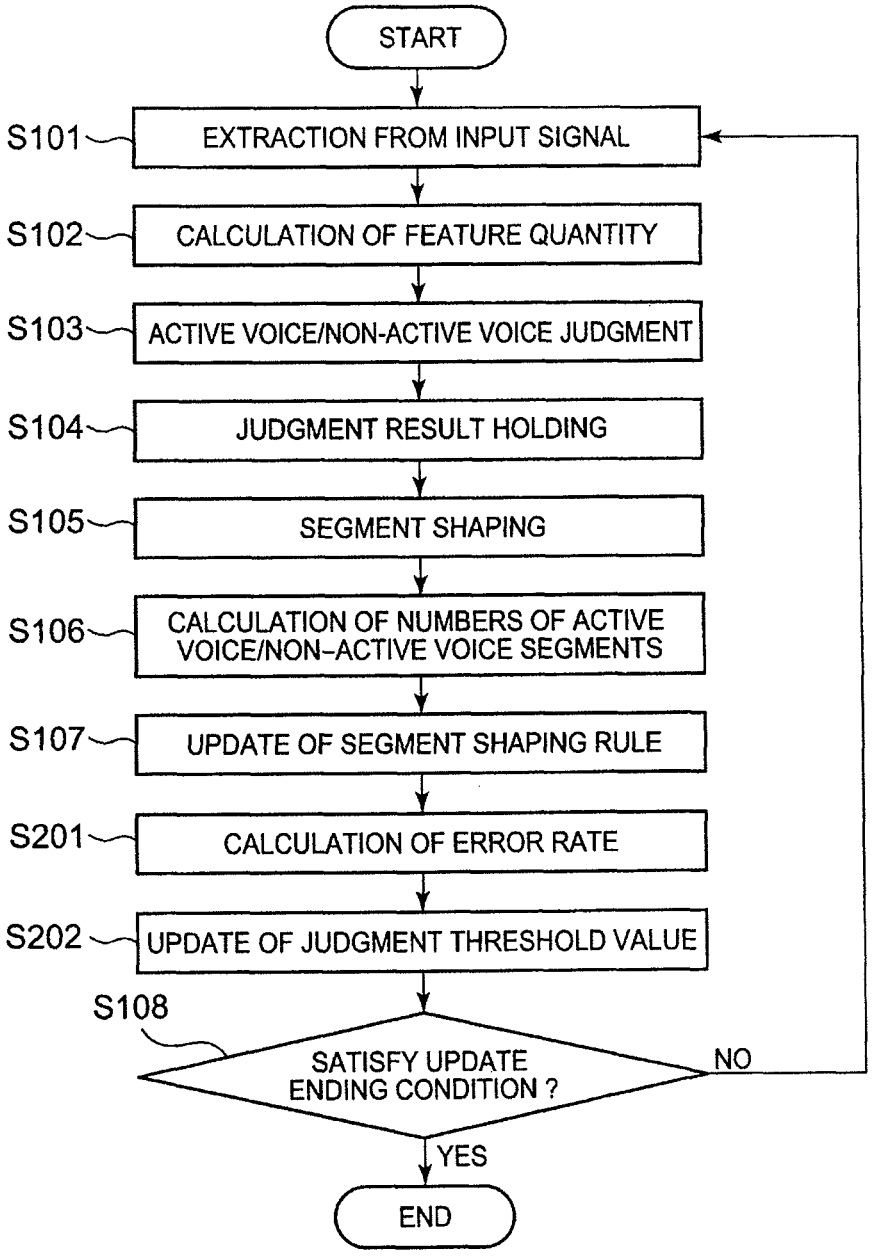
FIG. 8 It depicts a flow chart showing an example of the progress of the learning process in the second embodiment.

FIG. 8 is a flow chart showing an example of the progress of the learning of the parameters of the segment shaping rules in the second embodiment, wherein steps equivalent to those in the first embodiment are assigned the same reference characters as those in FIG. 4 and repeated explanation thereof is omitted. The operation from the extraction of the waveform data of each frame from the sample data to the update of the parameters (the active voice duration threshold and the non-active voice duration threshold) by the segment shaping rule updating unit 150 (steps S101-S107) is identical with that in the first embodiment.

After the step S107, the error rate calculating unit 220 calculates the error rates (FRR, EAR). The error rate calculating unit 220 calculates the FRR (the rate of misjudging an active voice segment as a non-active voice segment) according to the following expression (13) (step S201):

$$\text{FRR}=\text{(the number of active voice frames misjudged as non-active voice frames)}\div\text{(the number of correctly judged active voice frames)} \quad (13)$$

The "number of active voice frames misjudged as non-active voice frames" means the number of frames misjudged to correspond to non-active voice segments (in the judgment result after the shaping by the active voice/non-active voice segment shaping unit 107) in contradiction to their labels representing active voice segments. The "number of correctly judged active voice frames" means the number of frames correctly judged to correspond to active voice segments (in the judgment result after the shaping) in agreement with their labels representing active voice segments.

Meanwhile, the error rate calculating unit 220 calculates the FAR (the rate of misjudging a non-active voice segment as an active voice segment) according to the following expression (14):

$$\text{FAR}=\text{(the number of non-active voice frames misjudged as active voice frames)}\div\text{(the number of correctly judged non-active voice frames)} \quad (14)$$

The "number of non-active voice frames misjudged as active voice frames" means the number of frames misjudged to correspond to active voice segments (in the judgment result after the shaping by the active voice/non-active voice segment shaping unit 107) in contradiction to their labels representing non-active voice segments. The "number of correctly judged non-active voice frames" means the number of frames correctly judged to correspond to non-active voice segments (in the judgment result after the shaping) in agreement with their labels representing non-active voice segments.

In the next step S202, the threshold value updating unit 230 updates the judgment threshold value θ stored in the threshold value storage unit 103 using the error rates FFR and FAR. The threshold value updating unit 230 may update the judgment threshold value θ according to the following expression (15):

$$\theta \leftarrow \theta - \epsilon'' \times (\alpha \times \text{FRR} - (1-\alpha) \times \text{FAR}) \quad (15)$$

In the expression (15), "θ" on the left side represents the judgment threshold value after the update and "θ" on the right side represents the judgment threshold value before the update. Thus, the threshold value updating unit 230 may calculate $\theta - \epsilon'' \times (\alpha \times \text{FRR} - (1-\alpha) \times \text{FAR})$ using the judgment threshold value 0 before the update and then regard the calculation result as the judgment threshold value after the update. The character $\epsilon''$ in the expression (15) represents the step size of the update, that is, a value specifying the magnitude of the update. The step size $\epsilon''$ may be set at the same value as $\epsilon$ or $\epsilon'$ (see the expressions (1) and (2)), or changed from $\epsilon$ and $\epsilon'$.

After the step S202, whether the update ending condition is satisfied or not is judged (step S108) and the process from the step S101 is repeated when the condition is not satisfied. In this case, the judgment in the step S103 is made using θ after the update.

In the loop process of the steps S101-108, both the update of the parameters of the segment shaping rules and the update of the judgment threshold value may be executed each time, or the update of the parameters of the segment shaping rules and the update of the judgment threshold value may be executed alternately in the repetition of the loop process. It is also possible to repeat the loop process in regard to the parameters of the segment shaping rules or the judgment threshold value until the update ending condition is satisfied, and thereafter repeat the loop process in regard to the other.

As the update process represented by the expression (15) is executed multiple times, the rate between the two error rates approaches the rate indicated by the following expression (16). Therefore, "α" is a value which determines the rate between the error rates FAR and FRR.

$$FAR:FRR=\alpha:1-\alpha \quad (16)$$

The operation for executing the active voice detection to the input signal using the parameters of the segment shaping rules obtained by the learning is similar to that in the first embodiment. In this embodiment in which the judgment threshold value θ has also, been learned, the judgment on whether each frame corresponds to an active voice segment or a non-active voice segment is made by comparing the feature quantity with the learned θ.

Next, the effect of this embodiment will be explained.

While the judgment threshold value θ was constant in the first embodiment, the judgment threshold value θ and the parameters of the segment shaping rules are updated in the second embodiment so that the error rates decrease under the condition that the rate between the error rates approaches a preset rate. By previously setting the value of α, the threshold value is properly updated so as to implement active voice detection that satisfies the expected rate between the two error rates FRR and FAR. The active voice detection is used for various purposes. The appropriate rate between the two error rates FRR and FAR is expected to vary depending on the purpose of use. By this embodiment, the rate between the error rates can be set at an appropriate rate suitable for the purpose of use.

Third Embodiment

Figure 9:
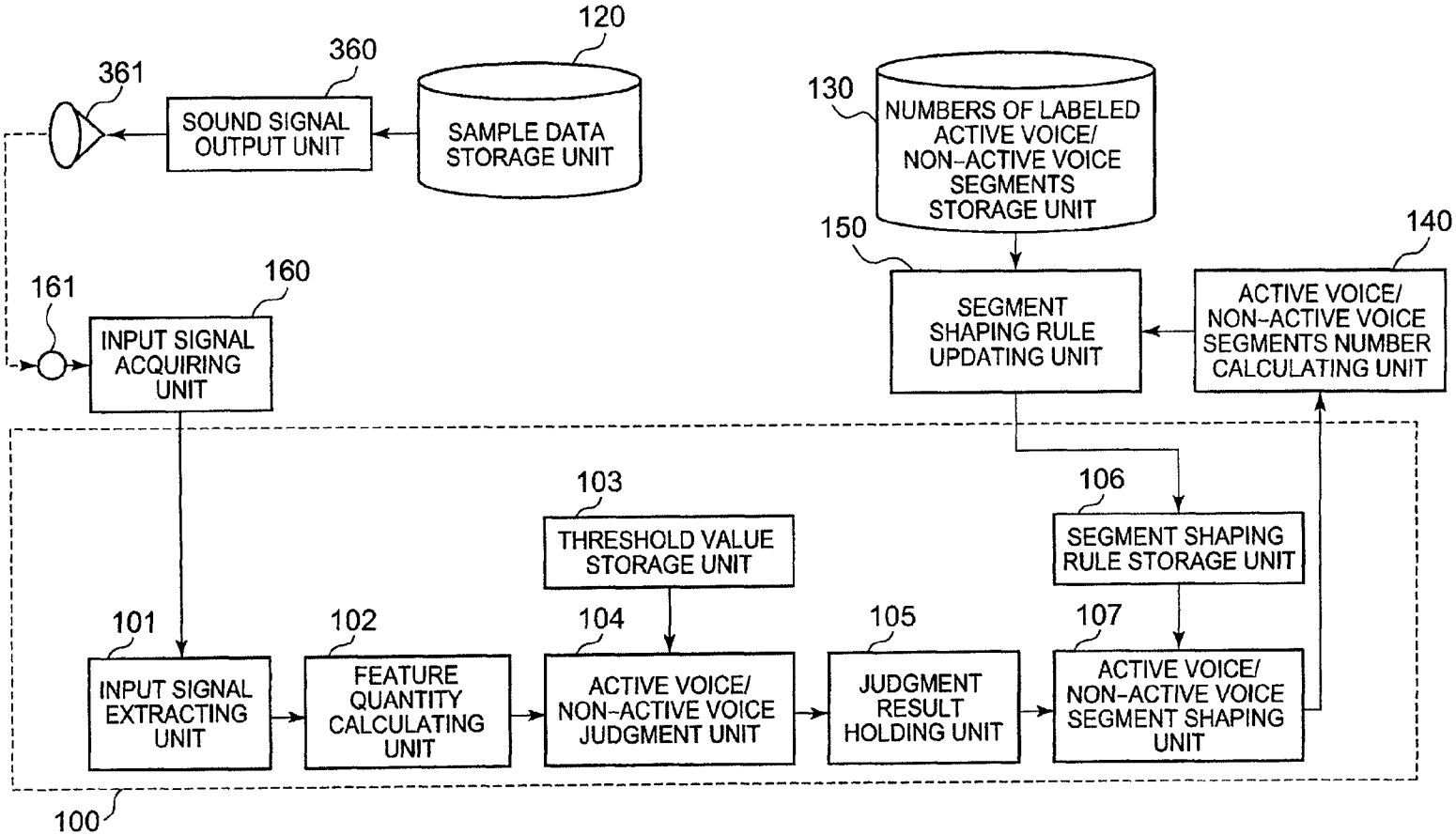
FIG. 9 It depicts a block diagram showing an example of the configuration of a voice activity detector in accordance with a third embodiment of the present invention.

In the first and second embodiments, the sample data stored in the sample data storage unit 120 was directly used as the input to the input signal extracting unit 101. In the third embodiment, the sample data is outputted as sound. The sound is inputted, converted into a digital signal, and used as the input to the input signal extracting unit 101. FIG. 9 is a block diagram showing an example of the configuration of a voice activity detector in accordance with a third embodiment of the present invention, wherein components equivalent to those in the first embodiment are assigned the same reference characters as those in FIG. 1 and repeated explanation thereof is omitted. The voice activity detector of the third embodiment includes a sound signal output unit 360 and a speaker 361 in addition to the configuration of the first embodiment.

The sound signal output unit 360 makes the speaker 361 output the sample data stored in the sample data storage unit 120 as sound. The sound signal output unit 360 is implemented by, for example, a CPU operating according to a program.

In this embodiment, the sound signal output unit 360 makes the speaker 361 output the sample data as sound in the step S101 in the learning of the parameters of the segment shaping rules. In this case, the microphone 161 is arranged at a position where the sound outputted by the speaker 361 can be inputted. Upon input of the sound, the microphone 161 converts the sound into an analog signal and inputs the analog signal to the input signal acquiring unit 160. The input signal acquiring unit 160 converts the analog signal to a digital signal and inputs the digital signal to the input signal extracting unit 101. The input signal extracting unit 101 extracts the waveform data of the frames from the digital signal. The other operation is similar to that in the first embodiment.

By this embodiment, noise in the ambient environment surrounding the voice activity detector is also inputted when the sound of the sample data is inputted, by which the parameters of the segment shaping rules are determined in the state also including the environmental noise (ambient noise). Therefore, the segment shaping rules can be set appropriately to the noise environment where the sound is actually inputted.

In the third embodiment, the voice activity detector may also be equipped with the label storage unit 210, the error rate calculating unit 220 and the threshold value updating unit 230 and thereby set the judgment threshold value θ similarly to the second embodiment.

The output results (output of the voice activity detection unit 100 for the inputted sound) obtained in the first through third embodiments are used by, for example, sound recognition devices (voice recognition devices) and devices for sound transmission.

Figure 10:
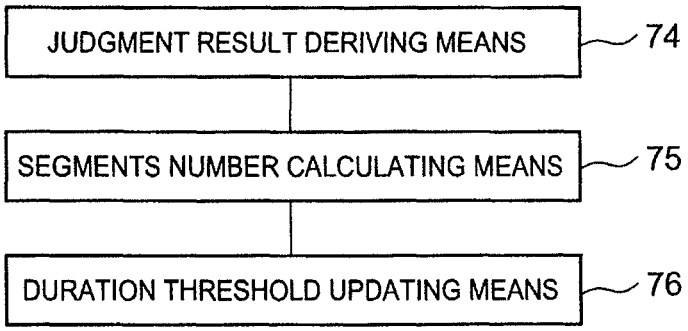
FIG. 10 It depicts a block diagram showing the general outline of the present invention.

In the following, the general outline of the present invention will be explained. FIG. 10 is a block diagram showing the general outline of the present invention. The voice activity detector in accordance with the present invention comprises judgment result deriving means 74 (e.g., the voice activity detection unit 100), segments number calculating means 75 (e.g., the active voice/non-active voice segments number calculating unit 140) and duration threshold updating means 76 (e.g., the segment shaping rule updating unit 150).

The judgment result deriving means 74 makes a judgment between active voice and non-active voice every unit time (e.g., on each frame) for a time series of voice data (e.g., the sample data) in which the number of active voice segments and the number of non-active voice segments are already known as a number of the labeled active voice segments and a number of the labeled non-active voice segments and shapes active voice segments and non-active voice segments as the result of the judgment by comparing the length of each segment during which the voice data is consecutively judged to correspond to active voice by the judgment or the length of each segment during which the voice data is consecutively judged to correspond to non-active voice by the judgment with a duration threshold (e.g., the active voice duration threshold or the non-active voice duration threshold).

The segments number calculating means 75 calculates the number of active voice segments and the number of non-active voice segments from the judgment result after the shaping. The duration threshold updating means 76 updates the duration threshold so that the difference between the number of active voice segments calculated by the segments number calculating means 75 and the number of the labeled active voice segments or the difference between the number of non-active voice segments calculated by the segments number calculating means 75 and the number of the labeled non-active voice segments decreases.

With such a configuration, the accuracy of the judgment result after the shaping can be increased.

The above embodiments have disclosed a configuration in which the judgment result deriving means 74 includes: frame extracting means (e.g., the input signal extracting unit 101) which extracts frames from the time series of voice data; feature quantity calculating means (e.g., the feature quantity calculating unit 102) which calculates a feature quantity of each extracted frame; judgment means (e.g., the active voice/non-active voice judgment unit 104) which judges whether each frame corresponds to an active voice segment or a non-active voice segment by comparing the feature quantity calculated by the feature quantity calculating means with a judgment threshold value as a target of comparison with the feature quantity; and judgment result shaping means (e.g., the active voice/non-active voice segment shaping unit 107) which shapes the judgment result of the judgment means by changing judgment results for consecutive frames judged identically when the number of the consecutive frames judged identically is less than the duration threshold.

The above embodiments have also disclosed a configuration in which the judgment result deriving means 74 changes the judgment results of consecutive frames judged to correspond to active voice segments into non-active voice segments when the number of the consecutive frames judged to correspond to active voice segments is less than a first duration threshold (e.g., the active voice duration threshold), while changing the judgment results of consecutive frames judged to correspond to non-active voice segments into active voice segments when the number of the consecutive frames judged to correspond to non-active voice segments is less than a second duration threshold (e.g., the non-active voice duration threshold), and the duration threshold updating means 76 updates the first duration threshold so that the difference between the number of active voice segments calculated by the segments number calculating means 75 and the number of the labeled active voice segments decreases (e.g., according to the expression (1)), while updating the second duration threshold so that the difference between the number of non-active voice segments calculated by the segments number calculating means 75 and the number of the labeled non-active voice segments decreases (e.g., according to the expression (2)).

The above embodiments have also disclosed a configuration in which the segments number calculating means 75 calculates the number of active voice segments and the number of non-active voice segments by regarding a set of one or more frames consecutively judged identically as one segment.

The above embodiments have also disclosed a configuration further comprising: error rate calculating means (e.g., the error rate calculating unit 220) which calculates a first error rate of misjudging an active voice segment as a non-active voice segment (e.g., the FRR) and a second error rate of misjudging a non-active voice segment as an active voice segment (e.g., the FAR); and judgment threshold value updating means (e.g., the threshold value updating unit 230) which updates the judgment threshold value so that rate between the first error rate and the second error rate approaches a prescribed value.

The above embodiments have also disclosed a configuration further comprising: sound signal output means (e.g., the sound signal output unit 360) which causes the sound data in which the number of active voice segments and the number of non-active voice segments are already known to be outputted as sound; and sound signal input means (e.g., the microphone 161 and the input signal acquiring unit 160) which converts the sound into a sound signal and inputs the sound signal to the frame extracting means. With this configuration, the duration threshold can be set appropriately to the noise environment where the voice is actually inputted.

While the present invention has been described above with reference to the embodiments and examples, the present invention is not to be restricted to the particular illustrative embodiments and examples. A variety of modifications understandable to those skilled in the art can be made to the configuration and details of the present invention within the scope of the present invention.

This application claims priority to Japanese Patent Application No. 2008-321551 filed on Dec. 17, 2008, the entire disclosure of which is incorporated herein by reference.

INDUSTRIAL APPLICABILITY

The present invention is suitably applied to voice activity detectors for judging whether each frame of a sound signal corresponds to an active voice segment or a non-active voice segment.

REFERENCE SIGNS LIST

100 voice activity detection unit
101 input signal extracting unit
102 feature quantity calculating unit
103 threshold value storage unit
104 active voice/non-active voice judgment unit
105 judgment result holding unit
106 segment shaping rule storage unit
107 active voice/non-active voice segment shaping unit
120 sample data storage unit
130 numbers of labeled active voice/non-active voice segments storage unit
140 active voice/non-active voice segments number calculating unit
150 segment shaping rule updating unit
160 input signal acquiring unit
210 label storage unit
220 error rate calculating unit
230 threshold value updating unit Reference Signs List

| | |
|---|---|
| 100 | voice activity detection unit |
| 101 | input signal extracting unit |
| 102 | feature quantity calculating unit |
| 103 | threshold value storage unit |
| 104 | active voice/non-active voice judgment unit |
| 105 | judgment result holding unit |
| 106 | segment shaping rule storage unit |
| 107 | active voice/non-active voice segment shaping unit |
| 120 | sample data storage unit |
| 130 | numbers of labeled active voice/non-active voice segments storage unit |
| 140 | active voice/non-active voice segments number calculating unit |
| 150 | segment shaping rule updating unit |
| 160 | input signal acquiring unit |
| 210 | label storage unit |
| 220 | error rate calculating unit |
| 230 | threshold value updating unit |

The invention claimed is:

1. A voice activity detector comprising:

judgment result deriving unit which makes a judgment between active voice and non-active voice every unit time for a time series of voice data in which the number of active voice segments and the number of non-active voice segments are already known as a number of the labeled active voice segment and a number of the labeled non-active voice segment, the judgment result deriving unit shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment;

segment number calculating unit which calculates the number of active voice segments and the number of non-active voice segments from the judgment result after the shaping; and duration threshold updating unit which updates the duration threshold so that the difference between the number of active voice segments calculated by the segment number calculating unit and the number of the labeled active voice segments decreases or the difference between the number of non-active voice segments calculated by the segment number calculating unit and the number of the labeled non-active voice segments decreases.

2. The voice activity detector according to claim 1, wherein the judgment result deriving unit includes:

frame extracting unit which extracts frames from the time series of voice data;

feature quantity calculating unit which calculates a feature quantity of each extracted frame;

judgment unit which judges whether each frame corresponds to an active voice segment or a non-active voice segment by comparing the feature quantity calculated by the feature quantity calculating unit with a judgment threshold value as a target of comparison with the feature quantity; and judgment result shaping unit which shapes the judgment result of the judgment unit by changing judgment results for consecutive frames judged identically when the number of the consecutive frames judged identically is less than the duration threshold.

3. The voice activity detector according to claim 2, wherein: the judgment result shaping unit changes the judgment results of consecutive frames judged to correspond to active voice segments into non-active voice segments when the number of the consecutive frames judged to correspond to active voice segments is less than a first duration threshold, while changing the judgment results of consecutive frames judged to correspond to non-active voice segments into active voice segments when the number of the consecutive frames judged to correspond to non-active voice segments is less than a second duration threshold, and the duration threshold updating unit updates the first duration threshold so that the difference between the number of the active voice segments calculated by the segment number calculating unit and the number of the labeled active voice segments decreases, while updating the second duration threshold so that the difference between the number of the non-active voice segments calculated by the segment number calculating unit and the number of the labeled non-active voice segments decreases.

4. The voice activity detector according to claim 2, wherein the segment number calculating unit calculates the number of the active voice segments and the number of the non-active voice segments by regarding a set of one or more frames consecutively judged identically as one segment.

5. The voice activity detector according to claim 2, further comprising:

error rate calculating unit which calculates a first error rate of misjudging an active voice segment as a non-active voice segment and a second error rate of misjudging a non-active voice segment as an active voice segment; and judgment threshold value updating unit which updates the judgment threshold value so that rate between the first error rate and the second error rate approaches a prescribed value.

6. The voice activity detector according to claim 1, further comprising:

sound signal output unit which causes the voice data in which the number of the active voice segments and the number of the non-active voice segments are already known to be outputted as sound; and sound signal input unit which converts the sound into a sound signal and inputs the sound signal to the judgment result deriving unit.

7. A parameter adjusting method comprising the steps of:

making a judgment between active voice and non-active voice every unit time for a time series of voice data in which the number of active voice segments and the number of non-active voice segments are already known as a number of the labeled active voice segment and a number of the labeled non-active voice segment, and shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment;

calculating the number of active voice segments and the number of non-active voice segments from the judgment result after the shaping; and updating the duration threshold so that the difference between the number of active voice segments calculated from the judgment result after the shaping and the number of the labeled active voice segments decreases or the difference between the number of non-active voice segments calculated from the judgment result after the shaping and the number of the labeled non-active voice segments decreases.

8. The parameter adjusting method according to claim 7, comprising the steps of:

extracting frames from the time series of voice data;

calculating a feature quantity of each extracted frame;

judging whether each frame corresponds to an active voice segment or a non-active voice segment by comparing the calculated feature quantity with a judgment threshold value as a target of comparison with the feature quantity; and shaping the judgment result by changing judgment results for consecutive frames judged identically when the number of the consecutive frames judged identically is less than the duration threshold.

9. The parameter adjusting method according to claim 8, wherein: in the shaping of the judgment result, the judgment results of consecutive frames judged to correspond to active voice segments are changed into non-active voice segments when the number of the consecutive frames judged to correspond to active voice segments is less than a first duration threshold and the judgment results of consecutive frames judged to correspond to non-active voice segments are changed into active voice segments when the number of the consecutive frames judged to correspond to non-active voice segments is less than a second duration threshold, and in the updating of the duration threshold, the first duration threshold is updated so that the difference between the calculated number of the active voice segments and the number of the labeled active voice segments decreases and the second duration threshold is updated so that the difference between the calculated number of the non-active voice segments and the number of the labeled non-active voice segments decreases.

10. The parameter adjusting method according to claim 8, wherein the calculation of the number of the active voice segments and the number of the non-active voice segments is executed by regarding a set of one or more frames consecutively judged identically as one segment.

11. The parameter adjusting method according to claim 8, further comprising the steps of:

calculating a first error rate of misjudging an active voice segment as a non-active voice segment and a second error rate of misjudging a non-active voice segment as an active voice segment; and updating the judgment threshold value so that rate between the first error rate and the second error rate approaches a prescribed value.

12. The parameter adjusting method according to claim 7, further comprising the steps of:

causing the voice data in which the number of the active voice segments and the number of the non-active voice segments are already known to be outputted as sound; and converting the sound into a sound signal.

13. A non-transitory computer readable information recording medium storing a voice activity detection program which, when executed by a processor, performs a method comprising:

a judgment result deriving process of making a judgment between active voice and non-active voice every unit time for a time series of voice data in which the number of active voice segments and the number of non-active voice segments are already known as a number of the labeled active voice segment and a number of the labeled non-active voice segment, and shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment;

a segment number calculating process of calculating the number of active voice segments and the number of non-active voice segments from the judgment result after the shaping; and a duration threshold updating process of updating the duration threshold so that the difference between the number of active voice segments calculated by the segment number calculating process and the number of the labeled active voice segments decreases or the difference between the number of non-active voice segments calculated by the segment number calculating process and the number of the labeled non-active voice segments decreases.

14. The non-transitory computer readable information recording medium according to claim 13, wherein the judgment result deriving process includes:

a frame extracting process of extracting frames from the time series of voice data;

a feature quantity calculating process of calculating a feature quantity of each extracted frame;

a judgment process of judging whether each frame corresponds to an active voice segment or a non-active voice segment by comparing the feature quantity calculated by the feature quantity calculating process with a judgment threshold value as a target of comparison with the feature quantity; and a judgment result shaping process of shaping the judgment result of the judgment process by changing judgment results for consecutive frames judged identically when the number of the consecutive frames judged identically is less than the duration threshold.

15. The non-transitory computer readable information recording medium according to claim 14, wherein: the judgment result shaping process changes the judgment results of consecutive frames judged to correspond to active voice segments into non-active voice segments when the number of the consecutive frames judged to correspond to active voice segments is less than a first duration threshold, while changing the judgment results of consecutive frames judged to correspond to non-active voice segments into active voice segments when the number of the consecutive frames judged to correspond to non-active voice segments is less than a second duration threshold, and the duration threshold updating process updates the first duration threshold so that the difference between the number of the active voice segments calculated by the segment number calculating process and the number of the labeled active voice segments decreases, while updating the second duration threshold so that the difference between the number of the non-active voice segments calculated by the segment number calculating process and number of the labeled non-active voice segments decreases.

16. The non-transitory computer readable information recording medium according to claim 14, wherein the segment number calculating process calculates the number of the active voice segments and the number of the non-active voice segments by regarding a set of one or more frames consecutively judged identically as one segment.

17. The non-transitory computer readable information recording medium according to claim 14, further causing the computer to execute:

an error rate calculating process of calculating a first error rate of misjudging an active voice segment as a non-active voice segment and a second error rate of misjudging a non-active voice segment as an active voice segment; and a judgment threshold value updating process of updating the judgment threshold value so that rate between the first error rate and the second error rate approaches a prescribed value.

18. The non-transitory computer readable information recording medium according to claim 13, further causing the computer to execute:

a sound signal output process of causing the voice data in which the number of the active voice segments and the number of the non-active voice segments are already known to be outputted by a speaker as sound; and a sound conversion process of converting the sound into a sound signal.

19. A voice activity detector comprising:

judgment result deriving means which makes a judgment between active voice and non-active voice every unit time for a time series of voice data in which the number of active voice segments and the number of non-active voice segments are already known as a number of the labeled active voice segment and a number of the labeled non-active voice segment, the judgment result deriving means shaping active voice segments and non-active voice segments as the result of the judgment by comparing, with a duration threshold, the length of each segment during which the voice data is consecutively judged to correspond to active voice by the judgment or the length of each segment during which the voice data is consecutively judged to correspond to non-active voice by the judgment;

segment number calculating means which calculates the number of active voice segments and the number of non-active voice segments from the judgment result after the shaping; and duration threshold updating means which updates the duration threshold so that the difference between the number of active voice segments calculated by the segment number calculating means and the number of the labeled active voice segments decreases or the difference between the number of non-active voice segments calculated by the segment number calculating means and the number of the labeled non-active voice segments decreases.

* * * * *